United States Patent [19]

Oda et al.

[11] Patent Number: 4,838,581

[45] Date of Patent: Jun. 13, 1989

[54] JOINT STRUCTURE FOR A TUBE SUPPORT PLATE AND A TUBE

[75] Inventors: Noriyuki Oda, Chiba; Tetsuo Takehara, Yokohama; Katsumi Higashi, Iruma; Keiji Muramatsu, Ichikawa, all of Japan

[73] Assignee: Asahi Glass Company Ltd., Tokyo, Japan

[21] Appl. No.: 167,115

[22] Filed: Mar. 11, 1988

Related U.S. Application Data

[62] Division of Ser. No. 825,642, Feb. 3, 1986, Pat. No. 4,753,457.

[30] Foreign Application Priority Data

Feb. 5, 1985 [JP] Japan ..... 60-19323[U]
Feb. 25, 1985 [JP] Japan ..... 60-25903
May 28, 1985 [JP] Japan ..... 60-113123

[51] Int. Cl.[4] ..... F16L 59/16

[52] U.S. Cl. ..... 285/47; 285/187; 285/229; 285/422

[58] Field of Search ..... 285/41, 47, 187, 289, 285/422, 189, 226, 229; 165/83

[56] References Cited

U.S. PATENT DOCUMENTS

| | | | |
|---|---|---|---|
| 264,448 | 9/1882 | Duffy | 285/226 |
| 2,615,308 | 10/1952 | Thorns | 165/907 |
| 2,916,307 | 12/1959 | Peters | 285/299 |
| 3,121,559 | 2/1964 | Tippmann | 165/83 |
| 3,217,798 | 11/1965 | Renzi | 165/907 |
| 3,298,680 | 1/1967 | Jablin | 285/9.2 |
| 3,407,870 | 10/1968 | Braune et al. | 165/83 |
| 3,488,067 | 1/1970 | Sommer | 285/41 |
| 4,024,905 | 5/1977 | Guillot | 165/9 |
| 4,041,591 | 8/1977 | Noll et al. | 165/165 |
| 4,134,449 | 1/1979 | La Haye et al. | 165/83 |
| 4,332,295 | 6/1982 | La Haye et al. | 165/905 |
| 4,526,635 | 7/1985 | Heinrich et al. | 165/165 |

FOREIGN PATENT DOCUMENTS

| | | | |
|---|---|---|---|
| 979943 | 12/1975 | Canada | 285/93 |
| 962437 | 4/1957 | Fed. Rep. of Germany . | |
| 1027699 | 4/1958 | Fed. Rep. of Germany . | |
| 1129975 | 5/1962 | Fed. Rep. of Germany . | |
| 2729038 | 1/1979 | Fed. Rep. of Germany . | |
| 1178105 | 5/1959 | France . | |
| 57-28988 | 2/1982 | Japan . | |
| 2138119 | 10/1984 | United Kingdom . | |

*Primary Examiner*—Randolph A. Reese
*Assistant Examiner*—Anthony Knight
*Attorney, Agent, or Firm*—Oblon, Spivak, McClelland, Maier & Neustadt

[57] ABSTRACT

In a joint structure for a tube support plate and a tube, a ceramic tube is provided aligned with a retaining hole of a tube support plate cooled by cooling medium and a bellows is placed in or near the retaining hole. An end of the bellows is fixed directly or indirectly to the tube support plate and the other end thereof is linked to the ceramic tube.

6 Claims, 10 Drawing Sheets

JOINT STRUCTURE FOR A TUBE SUPPORT PLATE AND A TUBE

This is a division of application Ser. No. 06/825,642, filed Feb. 3, 1986 now U.S. Pat. No. 4,753,457.

BACKGROUND OF THE INVENTION

The present invention relates to a joint structure for a tube support plate and a tube suitably applied to a dust-collecting apparatus for a hot gas, a heat exchanger for a hot gas and so on.

As a way for connecting in a gastight manner a metallic heat exchanger tube and tube support plate in a heat exchanger, there has been known the way of welding both members or the way of expanding the heat exchanger tube.

In the joint structure formed by welding the tube support plate and the metallic heat exchanger tube, however, there have been problems that the metallic heat exchanger tube has insufficient heat resisting and corrosion resisting properties so that it is difficult to treat gas of any high temperature range, and a joint portion formed by welding may be damaged due to stress caused by difference in thermal expansion.

Various kinds of metallic bellows have been used as means for absorbing expansion and contraction caused by difference in thermal expansion, while assuring gastight sealing in a case that a metallic heat exchanger tube is connected to a metallic tube support plate. Namely, one end of the bellows is connected to the metallic tube support plate, and the other end is connected to the metallic heat exchanger tube by welding respectively. However, when a ceramic heat exchanger tube is used instead of the metallic tube, and gas having higher temperature than that of an ordinarily used hot gas is to be treated, it is impossible to use the bellows owing to its limited heat resisting properties. Further, it is difficult in practise to weld-joint the bellows to the ceramic heat exchanger tube. It is also difficult to directly weld-joint or bond the ceramic tube to the metallic tube support plate. Even if it is possible, the joint portion between the ceramic tube and the tube support plate, or the ceramic tube itself is broken by a thermal stress acting on the both members. Of course, it is impossible to employ a method of expanding a portion of the ceramic heat exchanger tube.

The inventors of the present invention have proposed in Japanese Unexamined Patent Publication No. 210489/1983 a joint structure attained by using combination of a resilient material such as ceramic cloth and fine particles such as silica sand, as a joint structure for jointing the ceramic heat exchanger tube with the tube support plate without suffering influence of thermal expansion. Although the proposed joint structure was effective, there were disadvantages in that when the number of sliding movements due to repeated thermal expansion and thermal contraction is large, the fine particles fall to thereby impair sealing properties, and the direction of the heat exchanger tube is limited to the vertical direction.

SUMMARY OF THE INVENTION

It is an object of the present invention to eliminate the disadvantage of the conventional technique and to provide a novel joint structure for a ceramic tube and a tube support plate.

According to the present invention, there is provided a joint structure for a ceramic tube and a tube support plate capable of treating a high temperature gas, absorbing repeated expansion and contraction with good durability, and maintaining satisfactory sealing properties.

The present invention is to eliminates the above-mentioned problems and provides an effective and long-life sealing means between fluids in and out of a ceramic tube by contriving a setting position of a bellows in a joint structure for a ceramic tube and a tube support plate cooled by cooling medium.

The present invention concerns a joint structure for a tube support plate and a tube which comprises a ceramic tube aligned with a retaining hole of a tube support plate cooled by cooling medium and a bellows having an end fixed directly or indirectly to the tube support plate and the other end linked to said ceramic tube.

In accordance with the present invention, an end of the bellows is fixed to the tube support plate and the other end is linked to the ceramic tube. In the description of the present invention, the expression of "A is linked to B" includes the concept of "A is indirectly connected to B so that displacement of B causes displacement of A". Accordingly, even when relative change in position between the ceramic tube and the tube support plate takes place in the axial direction of the tube or in the direction perpendicular to the axial line of the tube owing to difference in thermal expansion coefficient between the tube and the tube support plate, or such change repeatedly takes place, the joint structure of the present invention absorbs relative displacement of the both members without effecting substantial load and stress to the tube and the tube support plate, and maintains reliable sealing effect between them.

Since the tube support plate usually made of metal is cooled, the tube support plate can withstand a hot gas.

The bellows is preferably made of a metallic material such as stainless steel to increase durability. Under the condition that the bellows is exposed to a fluid having a temperature of 400° C. or higher, the permissible number of expansions and contractions caused by thermal expansion, i.e. the life time of the bellows, is extremely reduced. Accordingly, an expedient for preventing the bellows from exposure to high temperature conditions is needed.

In the present invention, an end of the bellows is fixed directly or indirectly to the tube support plate which is cooled by cooling medium so that the bellows is cooled due to conduction from the fixed portion and radiation to the cooled neighboring part of the fixed portion, whereby the bellows can be maintained at a low temperature. Accordingly, in treatment of a hot gas, the temperature of the bellows never exceeds an allowable temperature. In other words, treatment of the hot gas becomes possible.

In the present invention, it is preferable that the bellows is positioned facing the inner surface of the retaining hole of the tube support plate, whereby the entire length of the bellows emits a strong radiation to a broad area of the inner surface of the cooled retaining hole, resulting in lower temperature.

In case that the bellows is located facing the inner surface of the retaining hole, the distance between the bellows and the inner surface should be small to obtain good cooling effect by radiation. However, it is preferable to leave a space to permit a relative displacement of the tube to the tube support plate. In the present invention, the ceramic tube is aligned with the retaining hole. In other words, both the ceramic tube and the retaining hole have a substantially common axis. The ceramic tube is preferably inserted into the retaining hole. In this case, it is convenient that the other end of the bellows is linked to a part around the circumference of the tube and at a position slightly separated from the end surface of the tube.

It is not always necessary to insert the ceramic tube into the retaining hole. In this case, it is preferable that the other end of the bellows is linked to the end surface area of the tube.

In a preferred embodiment of the present invention, the ceramic tube is inserted in the bellows with a space and a heat insulating layer is provided in the space. With such construction, heating of the bellows having a heat resisting temperature lower than that of the tube by a radiation heat of the high temperature tube is avoided, and the tube support plate can cool the bellows effectively. Further, the tube is prevented from being cooled by the cooled bellows whereby temperature reduction of a fluid flowing in the tube is restricted and a high temperature fluid can hold its heat energy.

It is preferable that the heat insulating layer is made of at least one in a group consisting of a ceramic ring, a ceramic rope, powder of heat resisting inorganic material such as diatomaceous earth, ceramic fibers, asbestos and a metallic plate.

In another preferred embodiment of the present invention, a ring member is provided at the outer circumference of the tube; a metallic ring is provided at the outside of the ring member so as to be in association with the ring member in which the other end of the bellows is fixed to the metallic ring so as to be linked with the tube. Since the other end of the bellows is fixed to the metallic ring, the bellows and the metallic ring can be easily connected in a gastight manner by welding or by other methods. The combination of the bellows and the metallic ring allows formation of a complicated configuration or allows one to use the metallic ring having an accurately finished surface. Accordingly, the metallic ring and the tube can be easily connected in a gastight manner. It is also possible that the metallic ring can easily follow a relative displacement of the tube, hence the ring member. The ring member also serves to hold the heat insulating layer.

In the present invention, it is preferable that the tube support plate is provided with a flange member which is fixed to the plate and extends into the retaining hole, and an end of the bellows is fixed to the flange member. Such construction permits employment of a bellows having a simple cylindrical shape instead of the bellows having a shape of a frustum of a cone. If necessary, an actuating means which will be explained below can be easily used.

The flange member may be previously formed as a part of the tube support plate, or may be prepared separate from the tube support plate and is fixed to the plate in assembling operations.

As a structrue for linking the other end of the bellows with the ceramic tube, a structure in which the annular member is in press-contact with an end surface of the tube and the other end of the bellows is fixed to the annular member, may be preferably used. This structure allows employment of a tube having a simple configuration without necessity of formation of a ring member at the outer circumference of the tube. In this case, the actuating means is provided between the flange member and the annular member to impart a pushing force in the axial direciton of the tube so that the annular member is brought into press-contact with the end surface of the tube. By such construction, it is possible that the annular member is in press-contact with the end surface in a narrow space in the retaining hole, and a suitable gastight sealing is maintained depending on the strength of the tube and pressure difference between fluids flowing in and out of the tube. This construction is particularly effective when the pressure difference between the inside and the outside of the tube is 0.5 atmospheric pressure or higher.

The actuating means may be a spring or a hydraulic cylinder; however it is not limited to such means. The spring may be a coil spring or belleville springs.

Besides that the annular member is directly in press-contact with the end surface of the tube, the annular member may be in press-contact with a short ceramic tube having a shape of frustum of cone which is also in press-contact with the end surface of the tube. This construction enables to use a ceramic tube having a simple straight shape which is easily manufactured.

The joint structure of the present invention is applicable not only in the case that the ceramic tube is positioned at one side of the tube support plate but also in the case that ceramic tubes are positioned on both sides of the plate. In the latter case, a single ceramic tube may project from the both sides of the tube support plate, or two ceramic tubes may be used and one is projected from one side of the tube support plate and the other is projected from the other side of the plate. Thus, when two tubes are connected to the tube support plate, another ceramic tube which is separate from the tube to which the other end of the bellows is connected may be supported by the flange member. In this case, the flange member performs both functions of fixing the bellows and of rigidly supporting the other ceramic tube.

In the present invention, a metallic pipe may be positioned in the retaining hole to be cooled so as to face the inner surface of the retaining hole, and a bellows is positioned facing the metallic pipe subjected to radiation cooling. In this case, it is desirable that the metallic pipe is linked with the ceramic tube through the heat insulating layer provided around the outer circumference of the tube, and that the other end of the bellows is fixed to the metallic pipe.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiment of the present invention will be described with reference to the drawings.

Figure 1:
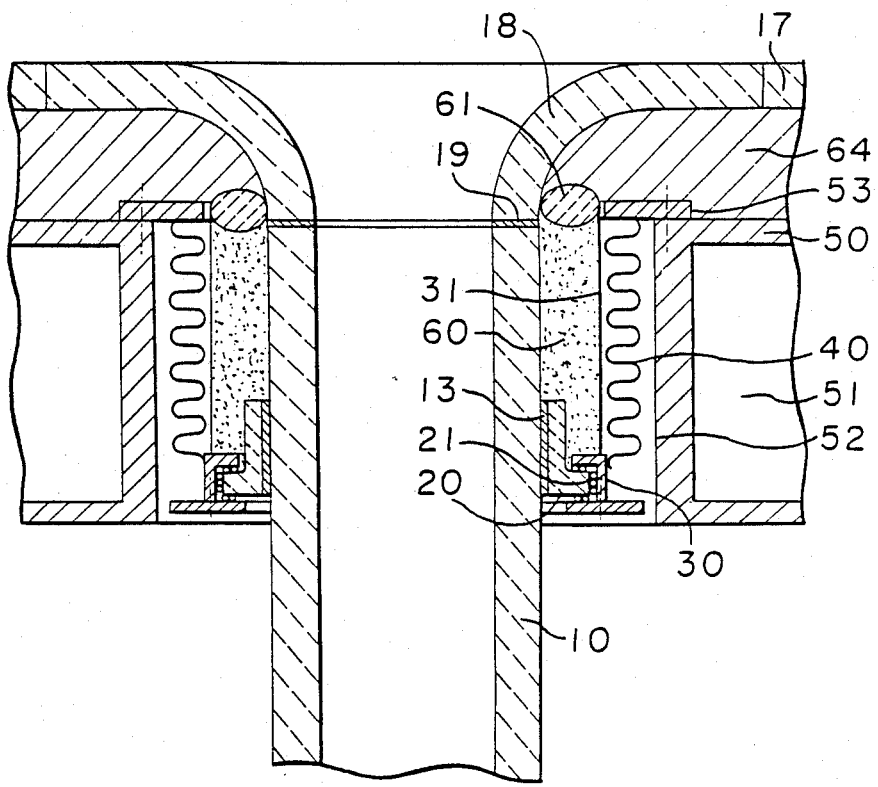
FIG. 1 is a longitudinal cross-sectional view of an important part of an embodiment of the joint structure according to the present invention.

FIG. 1 shows the first embodiment of the joint structure for connecting an end of a ceramic tube to a tube support plate.

In FIG. 1, a water chamber 51 is formed in a metallic tube support plate 50 and water as cooling medium flows in the water chamber 51 to cool the tube support plate 50. Liquid such as oil or gas such as air may be used as the cooling medium instead of water. A plurality of insertion holes as retaining holes are formed in the tube support plate 50, and a ceramic tube 10 is inserted in one of the insertion holes. An end of the ceramic tube 10 is connected to a ceramic ferrule 18 through an adhesive layer 19, and the end of the ferrule 18 opposite the ceramic tube 10 is adjacent to another ferrule 17 which belongs to an adjacent ceramic tube. A ceramic ring 20 having an L-shape in cross-section is bonded through an adhesive layer 13 to the outer circumference of the ceramic tube 10 at a position slightly lower than the end portion of the ceramic tube 10.

At the upper part of the tube support plate 50 and near the inner surface 52 of the insertion hole, a metallic flange member 53 is fixed to the tube support plate 50 by means of a bolt (the position of the bolt is shown by a one-dotted line) so that the inner part of the flange member 53 is inwardly projected from the inner surface 52. A heat insulating material 64 is packed in a space formed between the ferrules 17, 18 and the tube support plate 50. As the heat insulating material 64, a material which permits displacement of the ceramic tube 10 and displacement of the ferrule 17 and so on caused by the displacement of the ceramic tube 10, is preferably used.

A metallic ring 30 having a ⊥ like shape in cross-section is arranged between the lower part of the inner surface 52 of the insertion hole and the ceramic tube 10 so as to hold an outwardly projecting portion of the ceramic ring 20. A cushion member 21 made of ceramic rope, ceramic fibers or asbestos is provided between the metallic ring 30 and the ceramic ring 20 to maintain gastightness between them and to disperse a stress in the ceramic ring 20 which is caused by mutual contact of the metallic ring 30 and the ceramic ring 20. The cushion material 21 may be made of a material other than the above-mentioned or a packing material.

A bellows 40 in a cylindrical form is provided between the outer circumference of the ceramic tube 10 and the inner surface of the insertion hole to have the same axis as the ceramic tube 10. The bellows 40 faces the inner surface 52 of the cooled insertion hole, and the upper end of the bellows 40 is connected to the flange member 53 by welding, while the lower end is connected to the metallic ring 30 by welding. Accordingly, the bellows 40 is cooled at a desired temperature. A metallic pipe 31 formed by rolling a thin metallic plate whose lower end is fixed to the metallic ring 30 is provided between the bellows 40 and the ceramic tube 10. A heat insulating layer 60 is formed by packing powder of a heat resistant inorganic material such as diatomaceous earth between the metallic pipe 31 and the ceramic tube 10. The heat insulating layer 60 prevents cooling of the ceramic tube 10 and heating of the bellows 40. The insulating layer 60 consisting of inorganic powder improves gastight sealing properties between the ceramic ring 20 and the metallic ring 30, hence between the ceramic tube 10 and the tube support plate 50. In this case, the cushion member 21 serves to prevent the inorganic powder from leaking out. A scattering prevention member 61 made of a material such as ceramic rope is also provided above the heat insulating layer 60 to prevent the inorganic powder from scattering.

The metallic pipe 31 prevents an element such as the inorganic powder forming the heat insulating layer 60 from scattering, and prevents the powder of the heat insulating layer 60 from entering into the annular recesses of the bellows 40 so that expansion and contraction of the bellows 40 is not blocked. In addition, the metallic pipe 31 functions as a heat radiation preventing plate to suppress cooling of the ceramic tube 10 and heating of the bellows 40. Namely, the metallic pipe 31 functions as a part of the heat insulating layer 60.

The heat insulating layer 60 may be formed by a ceramic ring, ceramic rope, ceramic fibers, asbestos or else instead of the heat resisting inorganic powder such as diatomaceous earth or may be the combination of the powder of an inorganic material and at least one of the above-mentioned members. The scattering prevention member 61 and/or the metallic pipe 31 may be omitted depending on the members used.

When the flange member 53 is directly connected to the tube support plate 50 by means of bolts, the bellows 40 is cooled by thermal conduction. On the other hand, when sealing properties are considered to be important, the flange member 53 and the tube support plate 50 are fixed by interposing a packing formed of a material such as asbestos.

Since the metallic ring 30 has a ⊥ like shape in cross-section, the outwardly projecting portion of the ceramic ring 20 is held by a ⊐ like portion in cross-section as a part of the ⊥ like shape, whereby the metallic ring 30 is moved along with movement of the ceramic tube 10 in the axial direction. Accordingly, the heat insulating layer 60 follows the movement of the ceramic tube 10, and a relative sliding movement of the heat insulating layer 60 and the ceramic tube 10 will not occur. Therefore, the inorganic powder is prevented from leaking through the part of the cushion member 21, and reduction in gastight sealing properties due to leakage of the inorganic powder can be prevented.

Even though the ceramic tube 10 may shift in the direction perpendicular to the axial line of the tube 10, the metallic ring 30 and the heat insulating layer 60 can follow the tube 10 within the range of movement permissible to the bellows 40, and the gastight sealing properties can be maintained.

The metallic ring 30 has a portion projecting from the outer circumference in its lower part. The bellows 40 is welded on the upper part of the outer circumference of the ⊐ like portion. When the ceramic tube is moved in the direction perpendicular to the axial line of the ceramic tube 10 beyond a certain value, the projecting portion of the metallic ring 30 functions as a stopper so that the bellows 40, being weak in an abrasion, does not come to contact with the inner surface 52.

The above-mentioned embodiment of the present invention will be described in more detail with reference to FIGS. 2 to 13 in which the same reference numerals designate the same parts and therefore, description of these parts is omitted.

Figure 2:
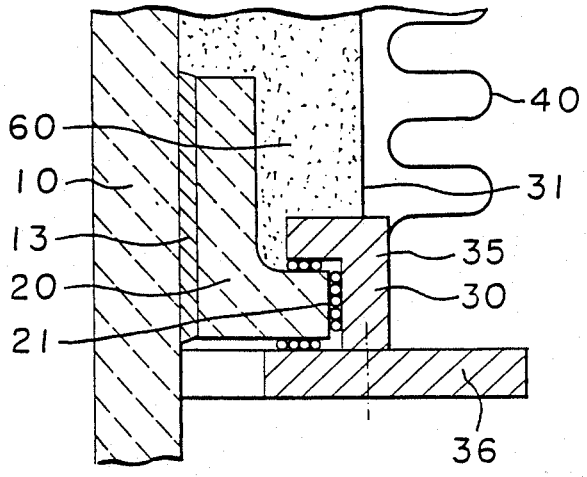
FIG. 2 is an enlarged cross-sectional view of an important part in FIG. 1.

FIG. 2 is an enlarged cross-sectional view of an important part shown in FIG. 1. The metallic ring 30 is formed by a metallic ring main body 35 of an inverse L-like shape in cross-section and a stopper portion 36. After the cushion member 21 is put in a space between the outwardly projecting portion of the ceramic ring 21 and the metallic ring main body 35 and another cushion member 21 is put in a space below the outwardly projecting portion, the stopper portion 36 and the metallic ring main body 35 are fastened by means of a bolt (the position of the bolt is shown by a one-dotted line).

Figure 3:
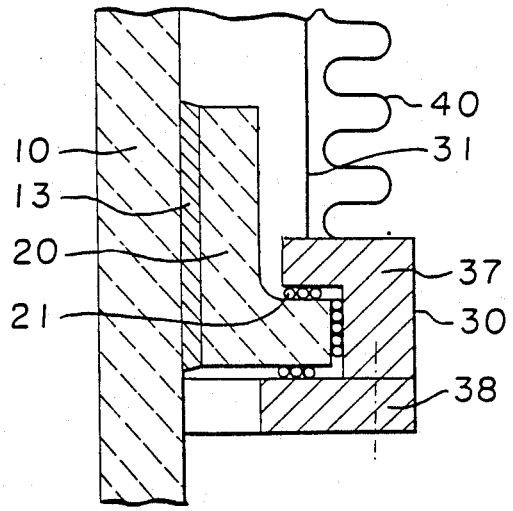
FIG. 3 is a cross-sectional view showing a modification of the embodiment shown in FIG. 2.

FIG. 3 shows another example of the joint structure similar to that of FIG. 2. The metallic ring 30 is formed by a metallic ring main body 37 and a pressing member 38. The bellows 40 is attached on the upper surface of the metallic ring main body 37 by welding, and the outer circumferential portion of the bellows 40 is positioned inside the outer circumference of the metallic ring main body 37. Accordingly, it is unnecessary to extend the pressing member 38 from the outer circumference of the metallic ring main body 37.

In the example of FIG. 3, no filler is filled between the metallic pipe 31 and the ceramic tube 10. Namely, when the joint structure of the embodiment shown in FIG. 3 is used under condition not so severe, a preferred heat insulating function can be performed by only the metallic pipe 31. When the joint structure is used under further mild condition in temperature, the metallic pipe 31 can be omitted.

Figure 4:
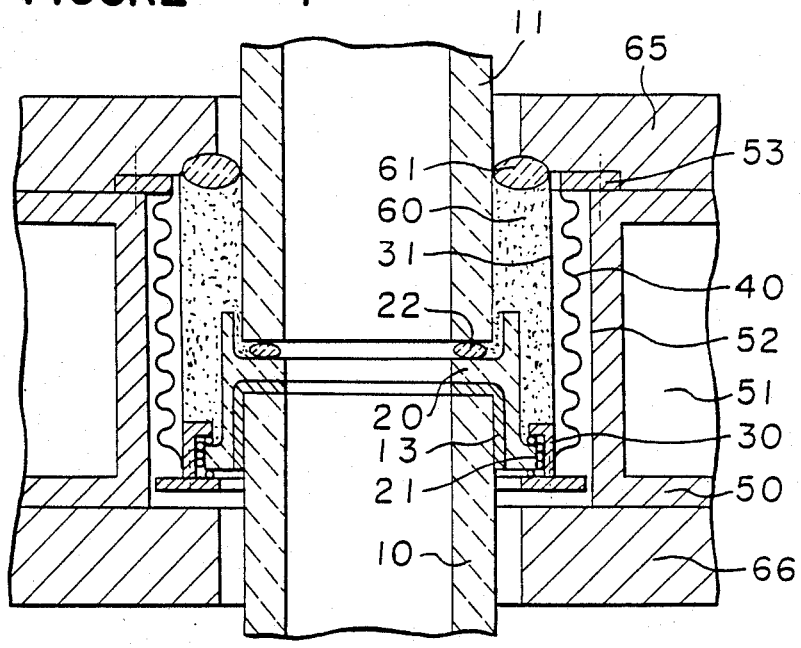
FIG. 4 is a longitudinal cross-sectional view of the second embodiment of the present invention.

FIG. 4 shows the second embodiment of the joint structure of the present invention in which the tube support plate is located at an abutting portion of two ceramic tubes. A long sized ceramic tube is generally difficult to be prepared. Even though it is possible, the strength of the ceramic tube is relatively low in comparison with an estimated external force. Accordingly, a plurality of ceramic tubes having a certain length are used by connecting them in the longitudinal direction. In this case, it is desirable that the tube support plate is positioned at the jointing portion of the ceramic tubes. However, there often take place misalignment of each insertion hole formed in a tube support plate with respect to each insertion hole formed in another tube support plate and misalignment of each ceramic tube due to manufacturing error. Accordingly, when a plurality of ceramic tubes are bonded at their abutting surfaces, differences of ununiform thermal expansion produced between adjacent ceramic tubes, between adjacent tube support plates and between the ceramic tube and the tube support plate can not be absorbed thereby resulting breakage of the ceramic tubes. In order to eliminate such disadvantage, the present invention is to provide a sealing structure without necessity of bonding ceramic tubes as shown in FIG. 4.

In FIG. 4, a ceramic ring 20 is bonded to the outer circumference of the upper end portion of the ceramic tube 10 through an adhesive layer 13. The ceramic ring 20 has an outwardly projecting portion and an inwardly projecting portion. The lower surface of the inwardly projecting portion is also bonded to the upper end surface of the ceramic tube 10 through the adhesive layer 13. The upper surface of the inwardly projecting portion is abutted to the lower end surface of the ceramic tube 11 by interposing a cushion member 22 made of a material similar to the cushion member 21. Thus, the ceramic ring 20 is not bonded to the ceramic tube 11. Sealing function between the both tubes is mainly performed by a heat insulating layer 60 made of powder of an inorganic material.

The heat insulating layer 60 allows the relative movement of the ceramic tube 11 and the ceramic tube 10 and the sealing function can be maintained. Linings of a heat insulating material 65 or 66 is provided on the upper and lower surface of the tube support plate 50 so that displacement of the ceramic tubes 10, 11 is admitted.

Figure 5:
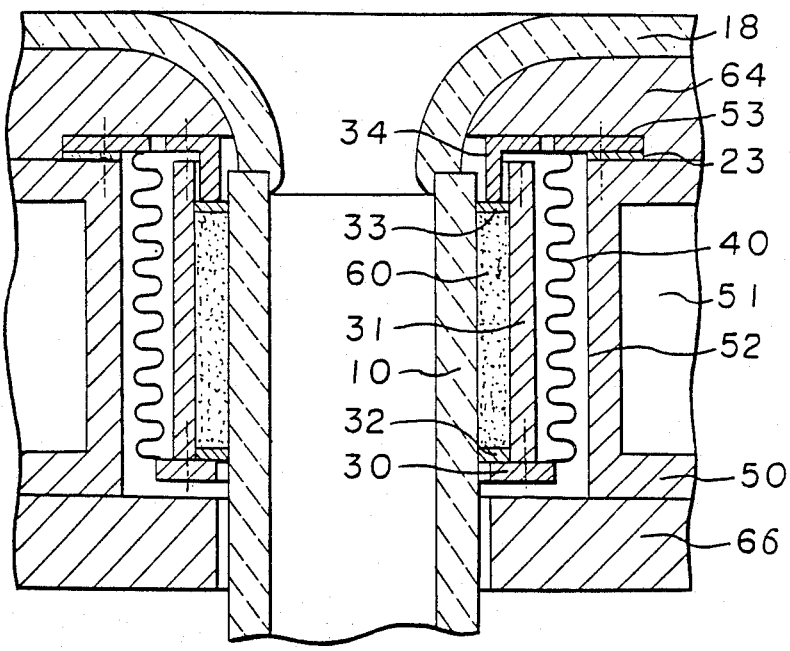
FIG. 5 is a longitudinal cross-sectional view of the third embodiment of the present invention.

FIG. 5 shows a structure preferably used for a case that there exists fairly large difference in pressure of a fluid flowing inside of the ceramic tube from a fluid flowing outside of the ceramic tube. A metallic pipe 31 formed by a thick metallic plate is firmly attached to the upper surface of a metallic ring 30 to which the lower end of the bellows 40 is welded. An annular anchoring member 32 whose inner diameter portion is almost in contact with the outer circumference of the ceramic tube 10 and whose outer diameter portion is almost in contact with the inner circumference of the metallic pipe 31 is placed on the upper surface at the inner side of the metallic ring 30. The heat insulating layer 60 is formed by packing a powdery inorganic material on the anchoring member 32. Another annular anchoring member 33 whose inner diameter portion is almost in contact with the outer circumference of the ceramic tube 10 and whose outer diameter portion is almost in contact with the inner circumference of the metallic pipe 31 is provided above the heat insulating layer 60. A fastening ring 34 having an inverse L-like shape in cross-section is provided on the anchoring member 33. A through hole is formed in a flange portion of the fastening ring 34 to receive a bolt. The bolt is screwed in a threaded hole formed in the upper surface of the metallic pipe 31 whereby the fastening ring 34 is fastened to the metallic pipe 31. In FIG. 5, the hole for receiving a bolt, the threaded hole and the bolt is omitted for simplification of the drawing and the positional relation for these elements is designated by a one-dotted line. The flange member 53 is fastened to the tube support plate 50 by interposing a packing 23.

Thus, since the fastening ring 34 is pressed downwardly, the inorganic powder constituting the heat insulating layer 60 is compressed between the anchoring members 32, 33. Accordingly, by a frictional force acting on the inorganic powder, leakage of the powder from a space surrounded by the ceramic tube 10 and metallic pipe 31 is prevented and therefore, sealing properties for the heat insulating layer 60 is increased. Thus, the embodiment shown in FIG. 5 provides such advantage that it is unnecessary to bond the ceramic tube to the ceramic ring as in the embodiments shown in FIGS. 1 and 4, and satisfactory sealing fucntion can be obtained even though pressure difference between fluids flowing in the interior and the exterior of the ceramic tube 10 is fairly large.

In the example shown in FIG. 5, connection between the ceramic tube 10 and the ferrule 18 is performed by engagement of shoulder portions formed in these members instead of bonding them by an adhesive.

Description has been made as to the case that the ceramic tube is vertically positioned, as preferred embodiments. However, the present invention is not limited to the embodiments. The present invention is applicable to a case that the ceramic tube is laterally positioned.

The joint structure according to the present invention is applicable to various fields. Preferably, the present invention is used for various kinds of dust filters for a hot gas and heat exchangers for a hot gas.

When the present invention is utilized for a dust filter for treating a hot gas, a ceramic tube of gas-permeable porous material is used, for example, and a dust-containing gas of a temperature as high as 400° C. or more is fed from the upper part of the lower part of the vertically arranged ceramic tubes. In this case, a clean gas is taken out of the ceramic tubes by passing through walls of the gas-permeable porous ceramic tubes.

In FIG. 1 showing the joint structure of the present invention, the dust-containing gas is fed from the upper part of the ferrule 18 to be introduced in the ceramic tube 10, and the clean gas is taken out of the ceramic tube 10 at the lower part of the tube support plate 50. The joint structure of the present invention provides reliable sealing in the dust filter.

When the joint structure of the present invention is used for a heat exchanger for treating a hot gas, the ceramic tube is made of a non-gas-permeable material, for example, and a hot gas of a temperature as high as about 1000° C. is introduced in the ceramic tube, whereas gas to be heated is flown outside the ceramic tube in the direction perpendicular to the axial direciton of the ceramic tube. Thus, effective sealing for the heating gas and the gas to be heated can be performed by the joint structure of the present invention.

In accordance with the present invention, it is possible that the dust-containing gas flows outside the ceramic tube and a clean gas flows inside the ceramic tube, and a heating gas flows outside the ceramic tube and gas to be heated flows inside the ceramic tube, although the embodiment as described with reference to FIG. 1 is preferably used.

In either case, the bellows effectively absorbs a relative displacement caused by difference in thermal expansion which is resulted between the ceramic tube 10 and the tube support plate 50 and between the ceramic tube 10 and a casing of an apparatus when the apparatus is started or stopped, or condition of operation such as variation in the temperature of the gas changes. Further, misalignment produced by manufacturing errors of the parts and assembling operations can be also absorbed.

EMBODIMENT

In the joint structure shown in FIG. 1, the ceramic tube was made of cordierite gas-permeable porous material having an inner diameter of 140 mm and diatomaceous earth having particle size of 4 μm–5 μm was used as the heat insulating layer 60. The bellows 40 and the metallic pipe 31 were respectively formed by a stainless steel plate of 0.3 mm thick and they were welded to the metallic ring 30 of the same material. Gas having a temperature of about 700°C. in which powder of red iron oxide was added to form an imitation of a hot dust-containing gas and air having a temperature near the room temperature were alternately introduced in the ceramic tube 10 downwardly at an interval of 30 minutes–1 hour. While the hot dust-containing gas was flown in the ceramic tube 10, a clean gas was recovered at the outside of the ceramic tube 10. Further, for the purpose of reverse cleaning, nitrogen gas having the room temperature was intermittently introduced in the ceramic tube 10 from the outer side to the inner side. Thus, simulation of a condition of repeated expansion and contraction due to difference in thermal expansion was achieved.

As a result, the temperature of the metallic pipe 31 was maintained to be about 300° C. and the temperature of the bellows 40 was maintained to be about 200° C. In this case, the quantity of expansion and contraction of the bellows 40 was about 9 mm and the load in the axial direction to the bellows 40 was about 40 kg. Accordingly, it was found that the admissible number of expansion and contraction of the bellows 40 is about 50000.

Figure 6:
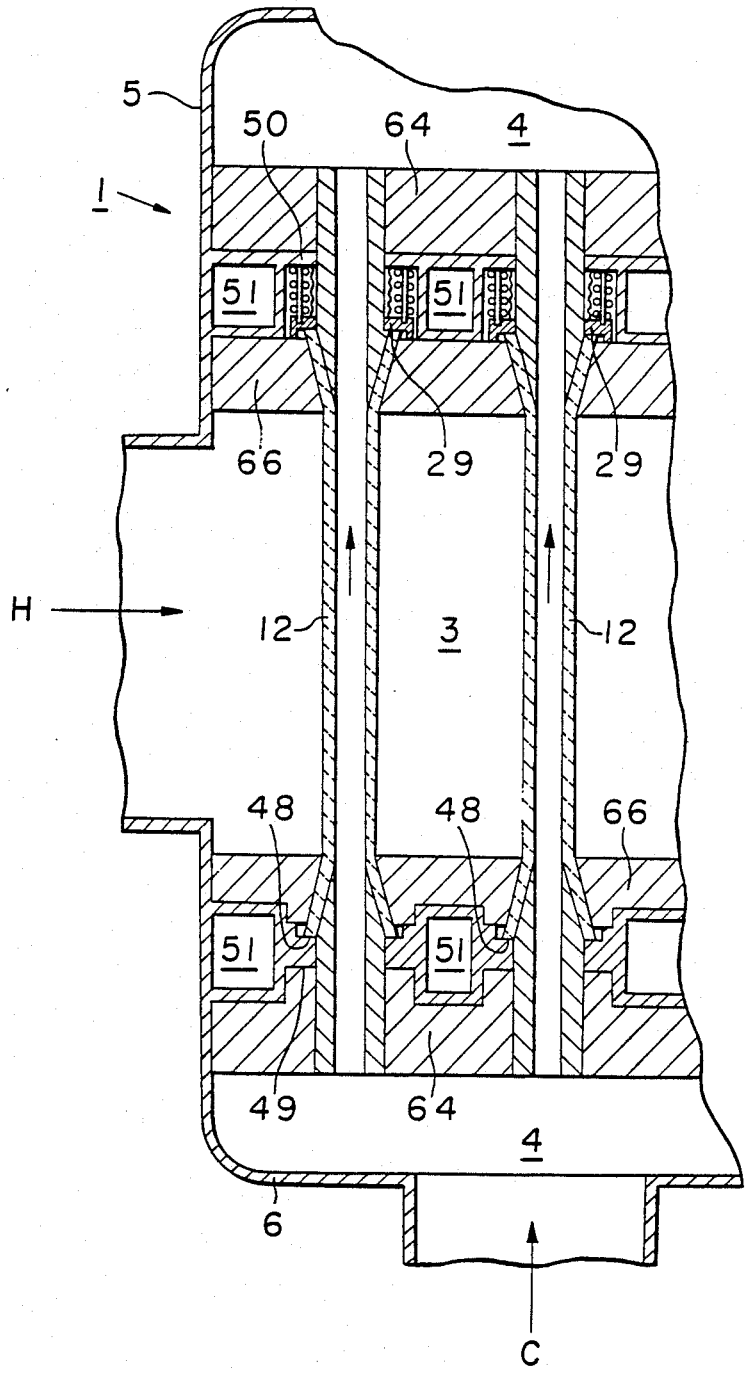
FIG. 6 is a longitudinal cross-sectional view partly omitted of a heat exchanger in which the fourth embodiment of the joint structure of the present invention is applied.
Figure 9:
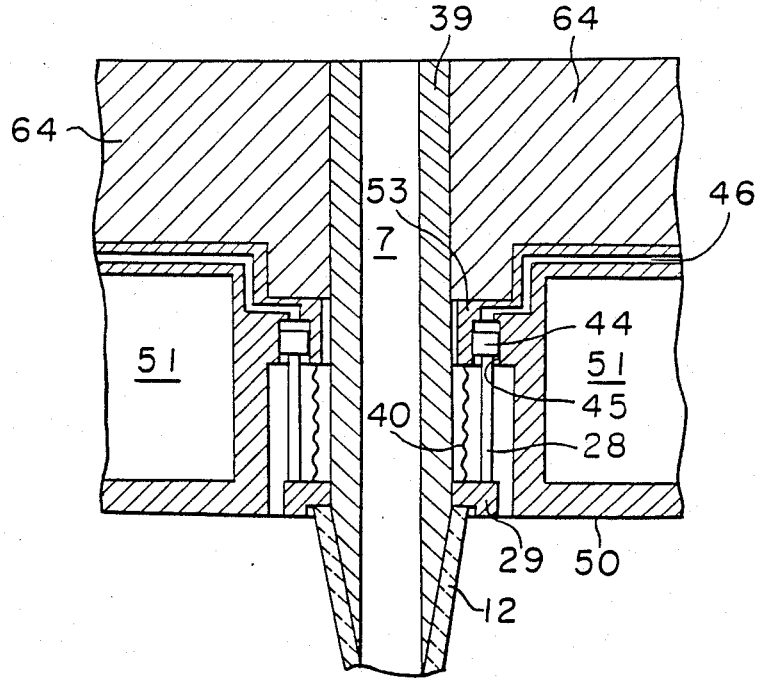
FIG. 9 is a cross-sectional view showing a modification of the joint structure shown in FIG. 7.
Figure 10:
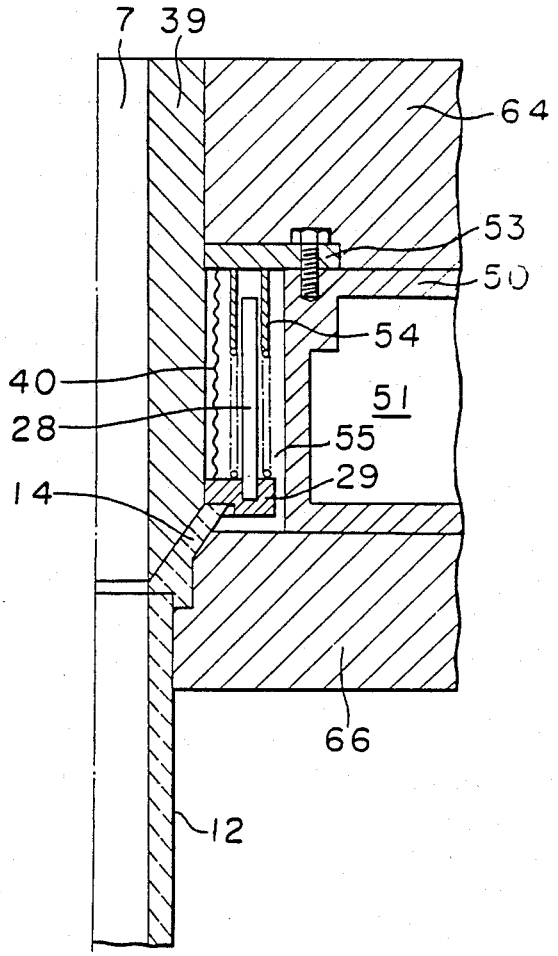
FIG. 10 is a cross-sectional view showing another modification of the joint structure shown in FIG. 7.

FIG. 6 shows the entire construction of the heat exchanger in which another modification of the joint structure according to the present invention is utilized. The detail of the joint structure used in the heat exchanger is shown in an enlarged view of FIG. 7. FIGS. 9 and 10 show modifications of the joint structure shown in FIG. 7. These joint structures are preferably employed in a case that pressure difference of fluids flowing inside and outside the ceramic tube is 0.5 atmospheric pressure or higher, especially, 1 atmospheric pressure or higher.

In FIG. 6, the heat exchanger 1 comprises a plurality of ceramic heat exchanger tubes 12 both of whose end portions are supported by a pair of tube support plates 49, 50. A space formed between the tube support plates 49, 50 provides a flow path 3 for a heating fluid (H) flowing in the transverse direction of the heat exchanger tubes 12. Both outer sides of the tube support plates 49, 50 are respectively surrounded by headers 5, 6 so that a flow path 4 for a fluid to be heated (C) which is fed from the header 6, passed through the heat exchanger tubes 12 and discharged through the header 5 is formed. A plurality of water chambers 51 are respectively formed in the tube support plates 49, 50. Both ends of each of the heat exchanger tubes 12 are enlarged in the diametrical direction and the end surfaces are subjected to a smoothing treatment. An upper end surface of each heat exchanger tube 12 is in press-contact with a lower surface of a metallic annular body 29 which is arranged in the retaining hole formed in the tube support plate 50 and the other end surface is in press-contact with a retaining surface 48 formed in the tube support plate 49. In this case, the lower surface of the annular body 29 and the retaining surface 48 of the tube support plate 49 are both subjected to a smoothing treatment so that these surfaces are in close-contact with the end surfaces of the heat exchanger tubes 12. The inner and outer surfaces of the tube support plates 49, 50 are respectively covered by the heat insulating material 64, 66.

Figure 7:
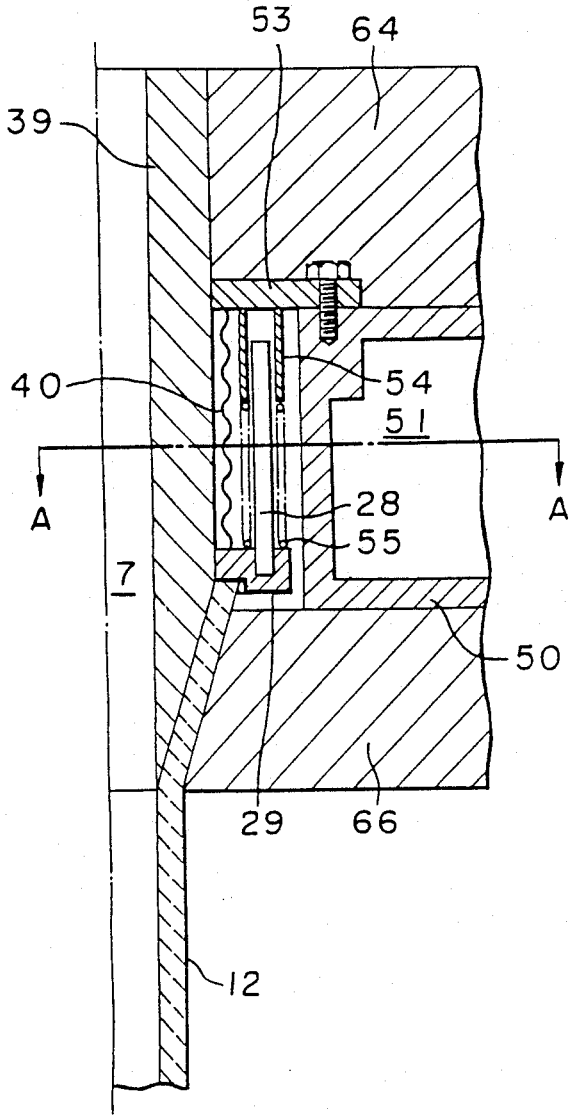
FIG. 7 is an enlarged cross-sectional view of an important part of the heat exchanger shown in FIG. 6.
Figure 8:
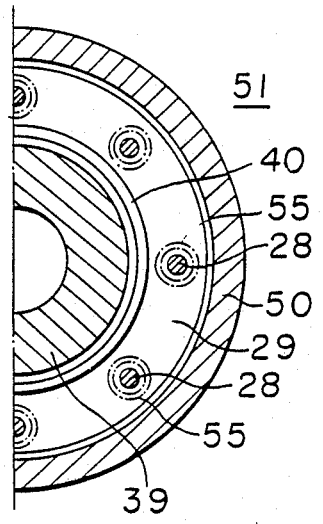
FIG. 8 is a transverse cross-sectional view taken along a A—A in FIG. 7.

As apparent from FIGS. 7 and 8, guiding rods 28 extend vertically from the upper surface of the annular body 29. The guiding rods 28 in a plural number (eight guiding rods are provided in this embodiment) are provided at the outer circumferential part of the annular body 29 at a given interval. A flange member 53 is fixed on the tube support plate 50. A plurality of cylindrical bodies 54 project from the lower surface of the flange member 53 in the number corresponding to the guiding rods and at the position corresponding to the guiding rods 28, and one end of each of the guiding rods 28 is inserted in each of the cylindrical bodies 54. Accordingly, the annular body 29 is supported to be movable along the axial direction of the heat exchanger tube 12 by means of the guiding rods 28.

A spring 55 (shown by one-dotted lines in FIGS. 7, 8 and 10) is disposed around each of the guiding rods 28 and interposed between the annular body 29 and the end of the cylindrical body 54. The spring 55 pushes the annular body 29 to the upper end surface of the heat exchanger tube 12. The spring 55 may be a coil spring or belleville springs. The other end surface of the heat exchanger tube 12 is in press-contact with the retaining surface 48 of the lower tube support plate 49 by the spring action of the spring 55.

The bellows 40 is provided between the annular body 29 and the flange member 53 so as to surround a flowing passage 7 for a fluid to be heated (C). Both ends of the bellows 40 are respectively welded to the flange member 53 and the annular body 29. An end of a heat insulating cylindrical material 39 which constitutes a circumferential wall of the flow passage 7 is in a tapered shape and is fitted to the enlarged diameter portion of the heat exchanger tube 12.

In the above-mentioned construction, the heating fluid (H) is fed into the flow path 3 to heat the heat exchange tube 12. The fluid to be heated (C) is fed from the header 6 through the heat exchanger tube 12 to the header 5 so that the fluid is heated by heat exchanging in the heat exchanger tube 12. The fluid to be heated (C) may be fed in the flow path 3, while the heating fluid (H) may be fed to the flow path 4.

The main body of the heat exchanger 1 and the tube support plates 49, 50 are made of metal, and accordingly, difference in thermal expansion coefficient between the ceramic heat exchanger tube 12 and the main body or the tube support plates causes a relative displacement between these members. The relative displacement of the heat exchanger tube 12 in the axial direction is absorbed by the movement of the annular body 29 in the axial direction owing to the spring action of the spring 55. The displacement of the heat exchanger tube 12 in its radial direction may be absorbed by the sliding movement of the both end surfaces of the heat exchanger tube 12 in the contacting surfaces. In this case, the sliding movement easily takes place because the contacting surfaces are subjected to a smoothing treament. Since this treatment enables the contacting surfaces at the both end surfaces of the heat exchanger tube 12 to be in close-contact, leakage of the fluid at this portion can be sufficiently prevented.

In the present invention, the smoothing treatment means that a surface is finished to have a surface roughness of 6.3 S or lower, especially, 0.8 S or lower, and the surface is so formed that it is in close-contact with another surface having the same surface roughness over the entire region of the end surfaces.

The bellows 40 maintains gastightness between the annular body 29 and the flange member 53. The spring 55, the bellows 40 and the annular body 29 made of metal which may not be durable to a high temperature are cooled by radiation effect because a water chamber 51 surrounds these members. Further, damage of these members which would be caused by heat radiation can be prevented because these members are arranged at the outside of the heat insulating material 39.

In the embodiment shown in FIG. 9, a piston 44 is attached to the end of each of the guiding rods 28 which are provided on the annular body 29 as similar to the embodiment shown in FIGS. 7 and 8, and the piston 44 is inserted into a cylinder 45 formed in the flange member 53 of the tube support plate 50. A pressurized fluid conduit 46 is formed in the tube support plate whereby a pressurized fluid is introduced into the cylinder 45 through the conduit 46. In this embodiment, the piston 44 is pushed by the pressurized fluid introduced on the upper part of the piston 44 in the cylinder 45 whereby the annular body 29 is pressed to the end surface of the heat exchanger tube 12 by means of the guiding rods 28.

FIG. 10 shows another modification of the joint structure shown in FIG. 7. In this embodiment, the heat exchanger tube 12 is a straight tube having a equal diameter over its entire length. A short ceramic tube 14 having a shape of substantially frustum of cone is used, and the end surface of a smaller diameter side of the short tube 14 is in contact with an end surface of the heat exchanger tube 12. A metallic annular body 29 is in contact with the end surface of a large diameter side of the short ceramic tube 14. A downwardly projecting portion is formed in the circumferential part of the end surface at the smaller diameter side of the short ceramic tube 14 so that the downwardly projecting part is fitted to the heat exchanger tube 12 to prevent displacement and coming off of the heat exchanger tube 12. The end surface of the heat exchanger tube 12, the both end surfaces of the short ceramic tube 14 and a surface of the annular body 29 which is in contact with the short ceramic tube 14 are respectively subjected to a smoothing treatment. Accordingly, gastightness between these members can be maintained and sliding movement in the contacting surfaces is possible under requisite condition.

Employment of the short ceramic tube 14 provides the following advantages. It is unnecessary to enlarge the end portions of the heat exchanger tube 12, and conduction of heat from the heat exchanger tube 12 to the annular body 29 is restricted. This is because resistance of heat conduction is increased by interposing the short ceramic tube 14 between them in comparison with the case that the heat exchanger tube 12 is directly in contact with the annular body 29 as in the embodiment shown in FIG. 7.

The short ceramic tube 14 may be in a disk shape having a central aperture as similar to the shape of the annular body 29. However, it is preferable for the tube 14 to have a shape of frustum of cone whereby the heat insulating cylindrical material 39 can be placed in the tapered portion of the short ceramic tube 14 thereby preventing over-heating of the bellows 40, the annular body 29, the spring 55 and so on which might be caused by a high temperature fluid flowing inside the heat exchanger tube 12.

In the present invention, the heat exchanger tube 12 is preferably made of ceramics having a sufficient strength and a large thermal conductivity. Specifically, a heat exchanger tube having a flexural strength of 20 $kg/mm^2$ or more with wall thickness of 5 to 10 mm and having a thermal conductivity of 20 kcal/m/h/K or more is preferably used. As an example of a material to satisfy the above-mentioned requirement, ceramics of silicon carbide may be used. On the other hand, as the short ceramic tube 14, ceramics of silicon nitride which has relatively low thermal conductivity and has the same strength as silicon carbide ceramics, may be used.

Figure 11:
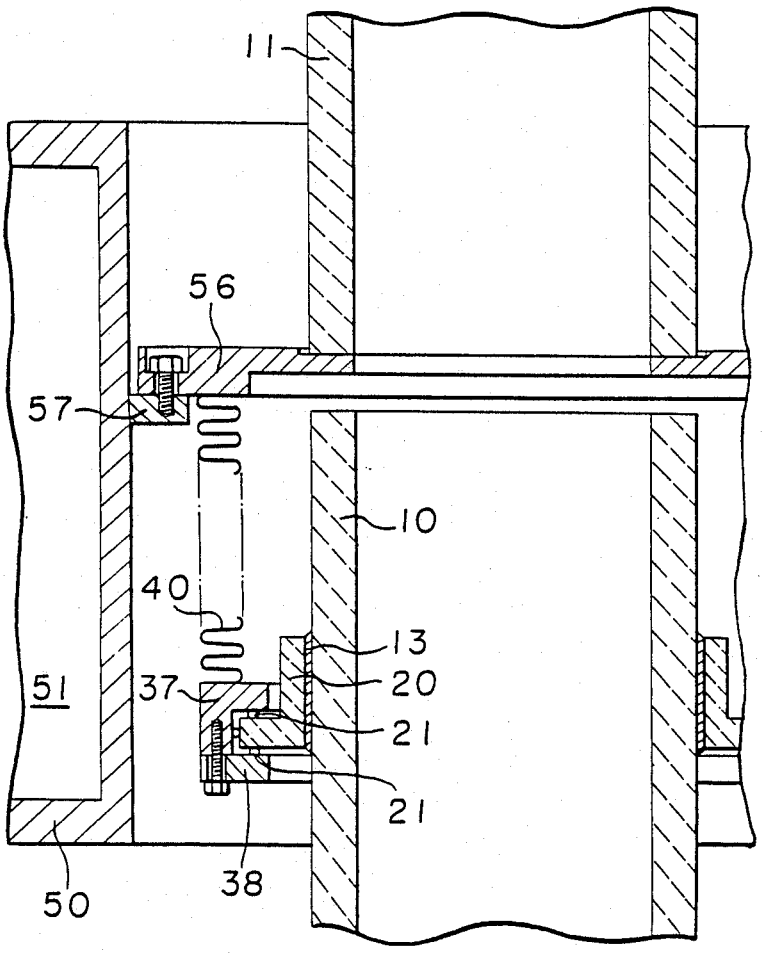
FIG. 11 is a longitudinal cross-sectional view of the fifth embodiment of the joint structure according to the present invention.
Figure 12:
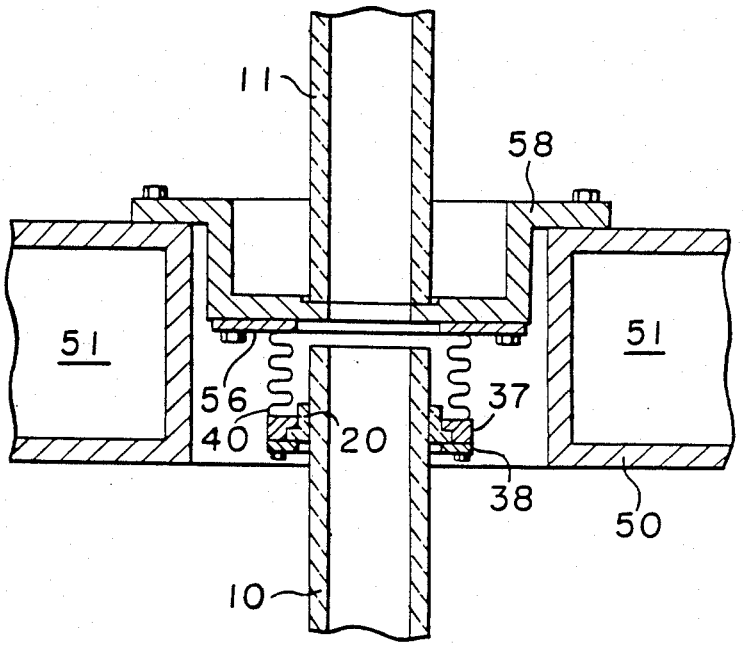
FIG. 12 is a cross-sectional view of the sixth embodiment of the present invention.
Figure 13:
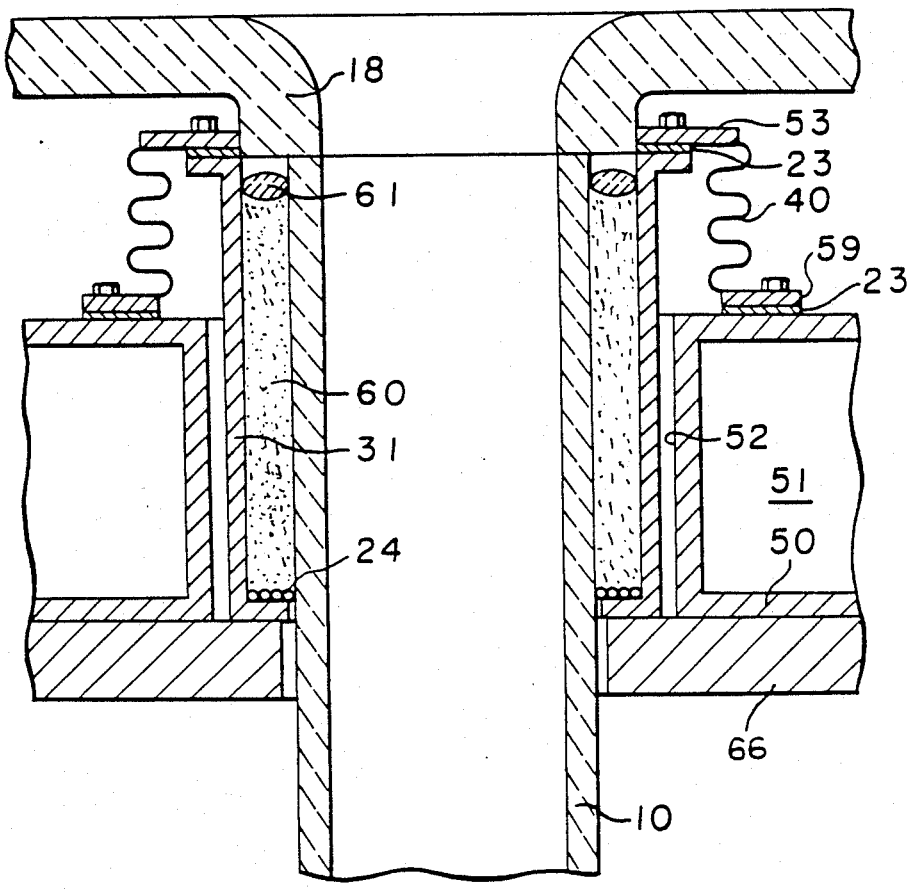
FIG. 13 is a cross-sectional view of the seventh embodiment of the present invention.

FIGS. 11, 12 and 13 respectively show separate embodiments of the present invention.

In FIG. 11, a metallic supporting piece 57 is provided projecting from the intermediate portion of the inner surface of the retaining hole of the tube support plate 50. The upper surface of the supporting piece 57 holds a metallic annular disk member 56 having a lower surface to which an end of the bellows 40 is welded and having an outer circumferential portion which is fastened to the supporting piece 57 by means of a bolt. The upper surface of the annular disk member 56 is subjected to a smoothing treatment and bears the lower smooth surface of the ceramic tube 11 in a press-contact state. In case the gastightness between a space over the tube support plate 50 and a space under it is not needed, a plurality of supporting pieces 57 may be provided intermittently along the inner circumference of the retaining hole. In case the gastightness between the space over the support tube plate 50 and the space under it is needed, an annular supporting piece 57 is used.

In the embodiment shown in FIG. 12, a metallic dish-like supporting member 58 having a central aperture is fixed on the upper surface of the tube support plate 50. On the bottom of the dish-like supporting member 58, the ceramic tube 11 is placed so as to maintain gastightness between the dish-like supporting member 58 and the ceramic tube 11. A metallic disk member 56, having a central aperture and having a lower surface to which an end of the bellows 40 is sealingly welded, is fastened to the lower surface of the bottom of the dish-like supporting member 58 by means of bolts.

In the embodiment shown in FIG. 13, the ceramic tube 10 is sealingly surrounded by a metallic tube 31 by interposing a heat insulating layer 60. The substantially lower half portion of the metallic tube 31 is surrounded by the insertion hole formed in the tube support plate 50. Accordingly, the metallic tube 31 is cooled by radiation, emitting its heat energy to the inner surface 52 of the insertion hole. A flange member 53 is fixed to the upper surface of the metallic tube 31, and a flat metallic ring 59 is fixed to the upper surface of the tube support plate 50. An end of the bellows 40 is welded to the flange member 53 and the other end of the bellows 40 is welded to the flat ring 59 respectively. Accordingly, the bellows 40 is cooled by the radiation, emittig its heat energy to the upper half portion of the cooled metallic tube 31. A packing member 24 is provided in the bottom portion of the metallic tube to prevent the powder of a heat resisting inorganic material from leaking.

As described above, in accordance with the present invention, sealing between the ceramic tube and the support plate is mainly performed by the bellows. One end of the bellows is fixed to the tube support plate and the other end is linked to the ceramic tube whereby a relative displacement between the ceramic tube and the tube support plate can be absorbed without any trouble. Further, since the bellows is fixed directly or indirectly to the cooled tube support plate, the temperature of the bellows is controlled to be low, hence the life time of the bellows can be prolonged. The present invention provides many excellent effects as described above and extremely effective for industrial fields.

We claim:

1. A joint structure for a tube support plate and a tube which is used in a hot gas system and comprises a ceramic filter tube aligned with a retaining hole of a tube support plate cooled by cooling medium and a metallic bellows having an end fixed directly or indirectly to said tube support plate and the other end linked to said filter tube, wherein an insulating layer is disposed in contact with the outer circumference of said insulating layer and the outer circumference of said insulating layer is surrounded by a metallic tube so as to be in mutual contact so that frictional forces are respectively produced between said filter tube and said insulating layer and between said insulating layer and said metallic tube, said bellows having its one end connected to said metallic tube.

2. A joint structure according to claim 1, wherein said bellows is placed facing the inner surface of said retaining hole.

3. A joint structure according to claim 1, wherein said ceramic tube is inserted in said retaining hole.

4. A joint structure according to claim 1, wherein said ceramic tube is inserted in said retaining hole with a space therebetween, and a heat insulating layer is formed in said space.

5. A joint structure according to claim 1, wherein said tube support plate is provided with a flange member which is fixed to said tube support plate and extends into said retaining hole, and said one end of said bellows is fixed to said flange member.

6. A joint structure according to claim 1, wherein said bellows is disposed facing the inner surface of said retaining hole of the tube support plate.

* * * * *